US008904932B2

(12) United States Patent
Kwarta et al.

(10) Patent No.: US 8,904,932 B2
(45) Date of Patent: Dec. 9, 2014

(54) PRODUCING BOUND DOCUMENT HAVING INNER COVER SHEET

(75) Inventors: Brian J. Kwarta, Pittsford, NY (US); Christopher J. White, Avon, NY (US)

(73) Assignee: Eastman Kodak Company, Rochester, NY (US)

( * ) Notice: Subject to any disclaimer, the term of this patent is extended or adjusted under 35 U.S.C. 154(b) by 304 days.

(21) Appl. No.: 13/558,776

(22) Filed: Jul. 26, 2012

(65) Prior Publication Data

US 2014/0030044 A1 Jan. 30, 2014

(51) Int. Cl.
*B41F 33/00* (2006.01)
*B42C 11/00* (2006.01)

(52) U.S. Cl.
USPC ..... 101/483; 412/4; 412/8; 412/19; 399/408; 281/29

(58) Field of Classification Search
USPC ..... 101/483, 484; 399/407–410; 412/4, 5, 412/8, 19–21; 281/21.1, 29, 37
See application file for complete search history.

(56) References Cited

U.S. PATENT DOCUMENTS 3,437,506 A * 4/1969 Falberg ..... 428/190
3,793,016 A 2/1974 Eichorn
3,909,141 A 9/1975 Staats
5,066,182 A * 11/1991 Stonebraker et al. ..... 412/3
6,685,415 B2 2/2004 Rush et al.
7,260,354 B2 8/2007 Ishida
7,326,018 B2 2/2008 Huotari
8,182,188 B2 5/2012 Manico et al.
8,437,683 B2 * 5/2013 Suzuki ..... 399/397
2008/0018090 A1 * 1/2008 Hoarau et al. ..... 281/21.1
2009/0263211 A1 * 10/2009 Peleman ..... 412/4
2011/0286779 A1 11/2011 Kwarta et al.

FOREIGN PATENT DOCUMENTS

EP 0 342 957 9/1993
JP 2006-058392 3/2006

* cited by examiner

*Primary Examiner* — Ren Yan
(74) *Attorney, Agent, or Firm* — Kevin E. Spaulding

(57) ABSTRACT

A bound document having a plurality of sheets is produced. Image data for a cover image is received and dividing along a sheet-edge curve into first and second image portions. The first image portion is printed on an inner cover sheet so that an alignment location is defined on the inner cover sheet corresponding to the sheet-edge curve. The inner cover sheet and the plurality of sheets are bound together. The second image portion is printed on an outer cover sheet, and is printed borderlessly with respect to a selected edge of the outer cover sheet. After the binding step, the outer cover sheet is affixed to the inner cover sheet so that the selected edge aligns with the alignment location to form the bound document.

16 Claims, 4 Drawing Sheets

PRODUCING BOUND DOCUMENT HAVING INNER COVER SHEET

CROSS-REFERENCE TO RELATED APPLICATIONS

This application is co-filed with and has related subject matter to U.S. patent application Ser. No. 13/558,700, filed herewith, titled "BOUND DOCUMENT HAVING PRINTED COVER SHEET," which is incorporated herein by reference.

FIELD OF THE INVENTION

This invention relates to making books with printed covers.

BACKGROUND OF THE INVENTION

Books and photo albums are commonly assembled from single- and double-sided printed documents and photographs. Traditional bookbinding methods include gluing or stitching a set of pages together along one edge. This bound edge is then attached to a book cover, either directly, or through attachment to a spine sheet. A spine sheet spans the spine of the cover without being attached to it, and is adhered only to the two sides of the cover. The spine sheet permits a user to fully open a finished book because it flexes separately from the spine of the cover. The bound edges of the manuscript are glued to the spine sheet or cover, and the spine sheet is glued to the cover.

However, there is an increasing volume of prints made at home, or in a retail establishment. There is also a growing movement again in specialty, small-print presses. Non-traditional book-makers, including specialty presses and retail photo lab operators, have a need for a process for binding materials that does not require the heavy equipment typically used in conventional bookbinding. These book-makers also have a need for printing images on the front and back covers and the spine. For example, coffee-table books often include a single image printed on all three of those surfaces so that the whole image can be viewed when looking at the outside of the open book. This is referred to herein as a "fully-wrapped cover."

Clamp- and ring-type binders, such as three-ring binders, do not have the appearance and function of conventional soft or hard covered books. Furthermore, these binders require a margin be provided in which perforations or other mounting features can be punched or placed. Moreover, sheets in these binders, e.g., three-ring binders, are susceptible to damage that permits pages to fall out, possibly without detection.

U.S. Pat. No. 7,326,018 describes a bundle of paper glue-bound to form a book. A glue band is wrapped around the bundle and heated to bind it. However, this scheme requires special equipment to wrap the glue band in a way that will not leave wrinkles or air bubbles in the band. Such wrinkles or bubbles would be perceptible to the touch of a person holding the book by the spine to read it, and could cause undesirable distraction or an impression of a lower-quality product.

U.S. Pat. No. 6,685,415 describes an adhesive matrix with a release liner. A cover is adhered to exposed adhesive after the release liner is removed. However, this scheme can leave a noticeable offset (at least the thickness of the matrix) between the endpapers at either end of the book. This can be objectionable. It also requires using a fixture to heat the adhesive matrix to attach to the inner sheets.

U.S. Pat. No. 3,909,141 describes a binding element having a flexible clamp with slots for the sheets. Although the cover is included, there are a limited number of slots, and a limited number of sheets (e.g., 1) can be inserted in each slot. Binding by this scheme is therefore limited in use, time-consuming, and tedious.

EP342957 issued to 3M (inventors Dwyer et al.) describes binding sheets together using pressure-sensitive adhesive. However, this scheme uses an adhesive spine, so does not provide full wrap-around covers.

There is, therefore, a continuing need for ways of producing bound books or other printed matter with lower cost than, and increased flexibility compared to, conventional bookbinding, while still proving a custom fully-wrapped cover. There is also a need for a way of producing books and book covers using a single printing device or technology, since many home users and retail establishments only have one type of printer (e.g., inkjet or thermal, respectively). There is also a need for books produced in these ways.

SUMMARY OF THE INVENTION

Moreover, none of the above-described schemes take into account that some printer technologies are limited in the size of sheets they can print. For example, optical printing is limited by the size of the field of view that can be exposed. Some cut-sheet printers are limited by the size of sheet that can be loaded into the input tray. For tall documents printed in portrait mode, in which the length (height) of a sheet significantly exceeds the width, hardware limits on sheet width set the widest sheet that can be printed. Since a book cover is generally more than twice as wide as the width of sheets in the book, these limits can make it difficult to produce a complete, covered book using a single printer (as opposed to one printer for the sheets and another for the cover).

According to an aspect of the present invention, there is provided a method of producing a bound document having a plurality of sheets, the method comprising:

receiving image data for a cover image;

dividing the image data along a sheet-edge curve into first and second image portions;

a first printing step of printing the first image portion on an inner cover sheet so that an alignment location is defined on the inner cover sheet corresponding to the sheet-edge curve;

binding the inner cover sheet and the plurality of sheets;

a second printing step of printing the second image portion on an outer cover sheet, wherein the second image portion is printed borderlessly with respect to a selected edge of the outer cover sheet; and a cover-affixing step of, after the binding step, affixing the outer cover sheet to the inner cover sheet so that the selected edge aligns with the alignment location to form the bound document.

According to another aspect of the present invention, there is provided a method of producing a bound document having a plurality of sheets, the method comprising:

receiving image data for a cover image;

dividing the image data along a sheet-edge curve into first and second image portions;

a first printing step of printing the first image portion on a supplemental cover sheet, wherein the first image portion is printed borderlessly with respect to a selected edge of the supplemental cover sheet;

binding an inner cover sheet and the plurality of sheets so that an alignment location is defined on the inner cover sheet corresponding to the sheet-edge curve;

a second printing step of printing the second image portion on an outer cover sheet, wherein the second image portion is printed borderlessly with respect to a selected edge of the outer cover sheet;

a supplemental-cover-affixing step of, after the binding step, affixing the supplemental cover sheet to the inner cover sheet so that the selected edge of the supplemental cover sheet aligns with the alignment location; and a cover-affixing step of, after the binding step, affixing the outer cover sheet to the inner cover sheet so that the selected edge aligns with the alignment location to form the bound document.

An advantage of this invention is that it can produce a bound book with a printed cover and printed inner sheets using a single type of printer. Various aspects can produce books with image data all the way around the cover even when the printer is not capable of printing a full-length outer sheet, i.e., an outer sheet that is more than twice as long as the inner sheets.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
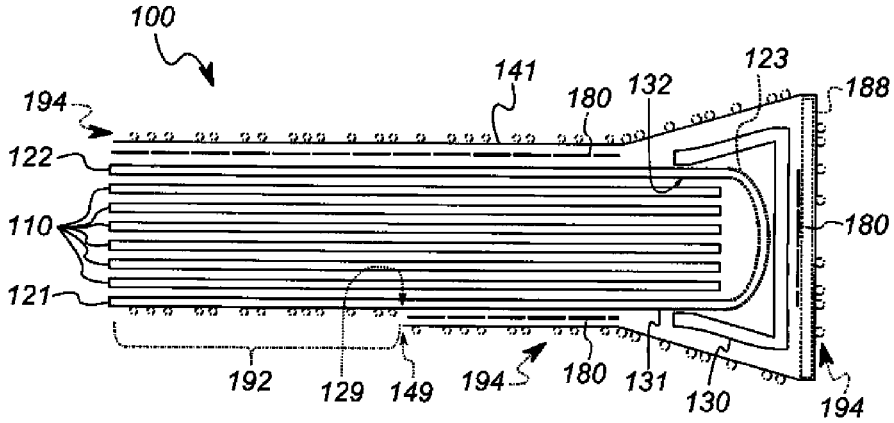
FIG. 1 is a cross-section of a bound document.

The attached drawings are for purposes of illustration and are not necessarily to scale.

DETAILED DESCRIPTION OF THE INVENTION

Reference is made to commonly-assigned U.S. Pat. No. 8,182,188, incorporated herein by reference.

In the following description, some aspects will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, methods described herein. Other aspects of such algorithms and systems, and hardware or software for producing and otherwise processing the image signals involved therewith, not specifically shown or described herein, are selected from such systems, algorithms, components, and elements known in the art. Given the system as described herein, software not specifically shown, suggested, or described herein that is useful for implementation of various aspects is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various aspects.

The electrophotographic (EP) printing process can be embodied in Electrostatographic printers such as electrophotographic printers that employ toner developed on an electrophotographic receiver can be used, as can ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying colorant to the receiver, and one or more post-printing finishing system(s) (e.g. a UV coating system, a glosser system, or a laminator system). Devices including printers, copiers, scanners, and facsimiles, and analog or digital devices, are all referred to herein as "printers." Electrophotographic, inkjet, thermal, optical, or other types of printers can be used. For example, an electrophotographic printer can be used, such as described in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

FIG. 1 is a cross-section of a bound document. Document 100 includes a plurality of sheets 110. In this example, sheets 110 form a stack. Sheets 110 can be printed (or not) cut sheets, or cut portions of media printed in a roll-fed printer. Roll-fed media can also be folded and bound so that the edges can be cut to form pages after document 100 is assembled. Sheets 110 can include, but are not limited to, natural and synthetic papers; synthetic sheets such as, but not limited to, plastic, MYLAR, or vinyl; cardboard and other paper or pulp materials; stiff fabrics; reinforced fabrics; mixed media sheets; photographs; metal sheets; glass plates; and other sheet-like materials.

Sheets 110 can be the same type of medium, or different media. Each medium independently can be decorative, plain, mixed media, or have attachments thereto. Commercially available media such as photobook pages, templates, and framing pages (for example, of paper, paperboard, cardboard), can be used. A medium can have a V-fold shape, such that the edge for insertion is the V-folded edge, the free edges forming the edges of the pages for turning in the book cover. Pop-up pages, and pages with extension sections that open out from the book cover, can also be used. Image content can be printed on one or more sheets 110 using thermal printing, ink jet (drop-on-demand or continuous), laser printing, electrophotographic printing, or other techniques.

Inner cover sheet 121 and second inner cover sheet 122 are on opposite sides of sheets 110. In this example and throughout the figures, sheets are represented as either rectangles or curves for clarity. This representational difference does not require structural difference.

Inner cover sheet 121, sheets 110, and (optionally) second inner cover sheet 122 are bound together. They can be bound together using a binder clip, staples, wire, thread, glue, or other binding techniques. In this example, binder clip 130 binds inner cover sheet 121, sheets 110, and second inner cover sheet 122 together. Sheets 110, inner cover sheet 121, and second inner cover sheet 122 can be the same length or different lengths, or can extend to the same distance from the spine or to different distances from the spine. As used herein, the term "binding device" refers to the mechanical device used to hold inner cover sheet 121, 122 and sheets 110 together. The binding device can be, e.g., a binder clip using spring force to hold the sheets together, or a plastic comb passing through punched holes in inner cover sheet 121, 122 and sheets 110 to hold them together.

Outer cover sheet 141 and inner cover sheet 121 together form a cover for document 100. Image data for a cover image is divided into first and second image portions. The first image portion is printed on inner cover sheet 121. The print is represented graphically as a plurality of dash-dotted circles forming image 192.

The second image portion is printed on outer cover sheet 141, represented graphically as a plurality of dash-dotted circles forming image 194, which extends around both sides of document 100 as shown. The second image portion is printed borderlessly with respect to a selected edge 149, which does not have to be straight, of outer cover sheet 141. Alignment location 129 is defined on inner cover sheet 121. Outer cover sheet 141 is affixed to inner cover sheet 121 so that selected edge 149 aligns (within tolerances) with alignment location 129. Images 192, 194 together form the cover image visible to a person inspecting the document. The arrows for location 129 and edge 149 are dotted for clarity.

Outer cover sheet 141 can be affixed to inner cover sheet 121 or second inner cover sheet 122 using adhesive 180, e.g., pressure-sensitive adhesive strips with or without substrates. Impregnated foamed adhesives, gel adhesives, and cast adhesive strips can also be used for adhesive 180. Examples of specific adhesive strips useful as adhesive 180 include APETAPE Adhesive Tapes (Essex, UK), JELLY double-sided Very High Bond Tape, 3M 4905 VHB Double-Sided Tape Clear Acrylic Adhesive, and 3M SCOTCH Exterior Mounting Tape 4011 and VHB Tapes, both adhesive and foam.

Spine shim 188 can optionally be affixed to binder clip 130 using adhesive 180 or another adhesive. This can provide a square spine appearance even when using rounded binder clips, wire binding, or other non-square binding technologies.

Inner cover sheet 121 can also be a continuous sheet wrapped around sheets 110, as shown by carry-through 123. A first-side inner cover portion on one side of the plurality of sheets 110 is defined, corresponding to inner cover sheet 121 as labeled. A second-side inner cover portion on the opposite side of the plurality of sheets 110 is also defined, corresponding to second inner cover sheet 122 as labeled. Either portion can be either the front or the back of the bound document.

Outer cover sheet 141 or inner cover sheets 121, 122 can be of any media, hard or soft. Examples of materials include, but are not limited to, cardboard, paperboard, plastic, paper, any type of animal skin, metal, metallic coated materials, and fabric. The book cover can include a section for insertion of a photograph, paper, memento, or other object on the front cover. The book cover, or at least a portion thereof, can be printable or printed using, for example, thermal printing, ink jet (drop-on-demand or continuous), laser printing, electrophotographic, or other techniques, or can be writable with pens, pencils, or markers.

The book cover can be the same dimensions as the media to be inserted. If it is desirable to have at least some of the media exposed, such as tabbed pages, when the book cover is closed, the book can be narrower than at least some of the media, shorter than at least some of the media, or both. To protect the media, the book cover can be wider than all the media, longer than all the media, or a combination thereof.

Outer cover sheet 141 can be creased or scored at its corners shown in FIG. 1 to permit folding outer cover sheet 141 around bound sheets 110.

Figure 2:
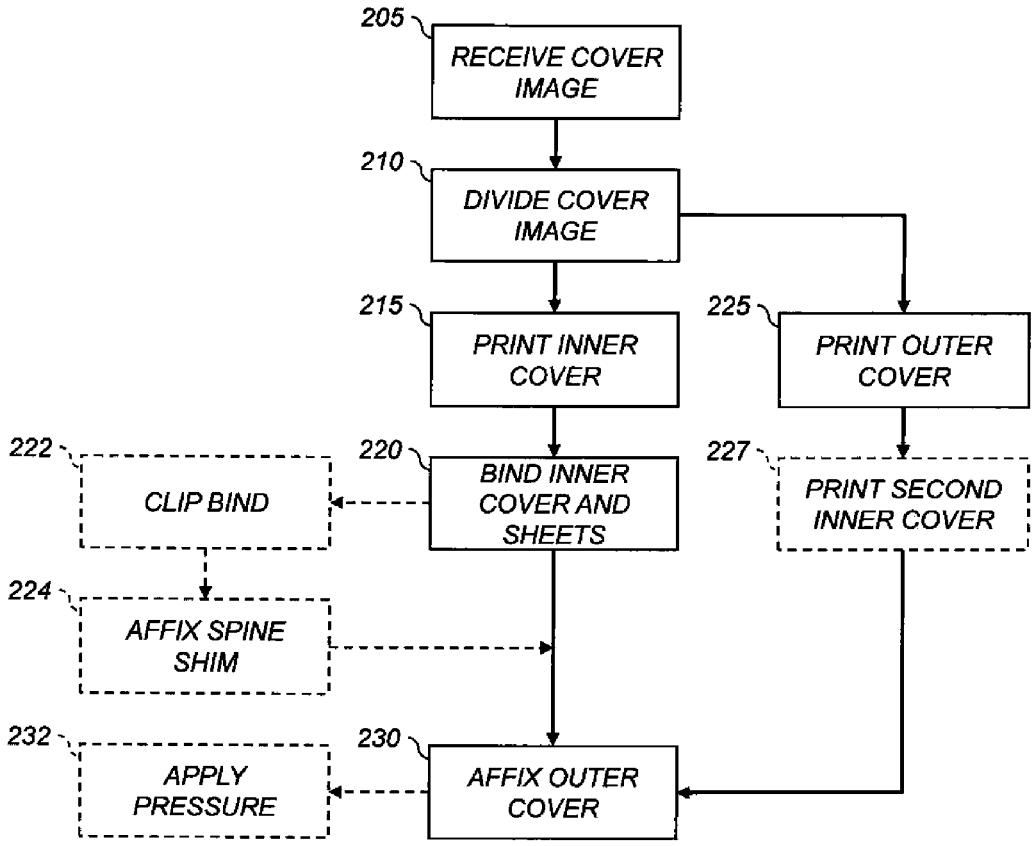
FIG. 2 is a flowchart showing ways of producing a bound document having a plurality of sheets.

FIG. 2 is a flowchart showing ways of producing a bound document having a plurality of sheets. Processing begins with step 205.

In step 205, image data for a cover image is received. Step 205 is followed by step 210.

In step 210, the image data for the cover image is divided along a sheet-edge curve into first and second image portions. The sheet-edge curve can be a straight line or another shape. Division can be performed by cropping or interpolating. In various aspects, the spatial resolution of the image data is reduced in a selected blur region (e.g., 10 pixels wide) including the sheet-edge curve. Data can be blurred, frosted, beveled, shadowed, or otherwise modified on either or both sides of the sheet-edge curve to reduce the visibility of the edge. In other examples, the image data can be modified to include features parallel to the sheet-edge curve; this can mask the sheet-edge curve by reducing the extent to which the curve is perceived apart from the content of the printed cover image. Step 210 is followed by step 215 and step 225.

In step 225, which is a second printing step, the second image portion is printed on an outer cover sheet. Steps 215, 225 can be performed in either order. The second image portion is printed borderless with respect to a selected edge, not necessarily straight, of the outer cover sheet. The outer cover sheet can be the same size as or larger than the inner cover sheet. First and second printing steps 215, 225 can include printing the first and second image portions, respectively, using a single printing device. Two identical or different printing devices can also be used. Steps 215, 225 can also include printing the first and second image portions, respectively, on respective sheets of a single type of media, e.g., photo paper, or on respective sheets of different types of media, e.g., glossy paper and matte paper. Step 225 is followed by step 230, or optional step 227.

In step 227, a second inner cover sheet is printed. Dividing step 210 further includes dividing the image data along a second sheet-edge curve to form a third image portion. In this step 227, a third printing step, the third image portion is printed on the second inner cover sheet so that a second alignment location is defined on the second inner cover sheet corresponding to the second sheet-edge curve. Binding step 220 further includes binding the second inner cover sheet opposite the plurality of sheets from the inner cover sheet. Second printing step 225 includes printing the second image portion borderlessly with respect to a second selected edge (straight or not) of the outer cover sheet. Cover-affixing step 230 further includes affixing the printed outer cover sheet to the second inner cover sheet so that the second selected edge aligns (within tolerances) with the second alignment location. Step 227 is followed by step 230.

In step 215, which is a first printing step, the first image portion is printed on an inner cover sheet. An alignment location is defined on the inner cover sheet corresponding to the sheet-edge curve. In various examples, the first image portion includes thumbnails or other graphical representations of content in the bound document, e.g., thumbnails of photos in a photobook. In other examples, the first image portion includes personalized content that is not merely representative of content appearing in the bound document. For example, the first image portion can include purchaser names, dedications, metadata or other information about the content, or print-shop or equipment-vendor marketing information (e.g., "printed on a KODAK printer"). Step 215 is followed by step 220.

In step 220, the inner cover sheet and the plurality of sheets are bound together. This can be done by various techniques, including clamping in a binder clip, wire-binding, saddlestitching, or other binding techniques. A second inner cover sheet can also be bound opposite the plurality of sheets from the inner cover sheet.

Step 220 can also include wrapping the inner cover sheet around the plurality of sheets to define first-side and second-side inner cover portions of the inner cover sheet on opposite sides of the plurality of sheets (either portion can be front or back). Cover-affixing step 230 can then include affixing the outer cover sheet to the first-side inner cover portion so that the selected edge aligns with the alignment location, and affixing the outer cover sheet to the second-side inner cover portion. Step 220 is followed by step 230, and can include optional steps 222 and 224.

In optional step 222, the inner cover sheet and the plurality of sheets are inserted into a binder clip and clamped therewith. The binder clip can include a center panel and two side panels, e.g., as shown in FIG. 1. The respective angle between the center panel and each side panel (e.g., angles A, B shown in FIG. 7) can be less than 90°. Step 222 is followed by step 224.

In optional step 224, a spine shim is affixed to the binder clip before cover-affixing step 230. The spine shim can be rectangular or another shape, can be thin (e.g., <=1 mm thick), and can be made from metal, plastic, or other materials rigid enough to withstand handling without deforming significantly. A spine shim provides the outer cover with a flat-spine look in aspects using binding methods that do not result in a flat spine, e.g., wire binding. Step 224 is followed by step 230.

In step 230, which is a cover-affixing step, after binding step 220, the outer cover sheet is affixed to the inner cover sheet so that the selected edge of the outer cover sheet aligns with the alignment location to form the bound document. As a result of the alignment, the first and second image portions align to form the full image. Alignment is performed within desired tolerances, e.g., 1 mm, (1/300)", or (1/600)". Tolerances can be selected based on the distance between the reader and the document, the resolution of the cover image, or the image content of the cover image. The sheet-edge curve, the alignment location, and the selected edge can be straight (within tolerances such as those given above) or curved. If a second inner cover sheet was used (step 220, above), the outer cover sheet can further be affixed to the second inner cover sheet. Step 230 can include optional step 232.

In optional step 232, pressure-sensitive adhesive (PSA) is used. Binding step 220 includes binding the inner cover sheet near a spine edge thereof, and the inner cover sheet includes pressure-sensitive adhesive (PSA) arranged closer to the spine edge than the alignment line. Cover-affixing step 230 includes this step 232, in which pressure is applied to affix the outer cover sheet to the inner cover sheet using the PSA.

Figure 3:
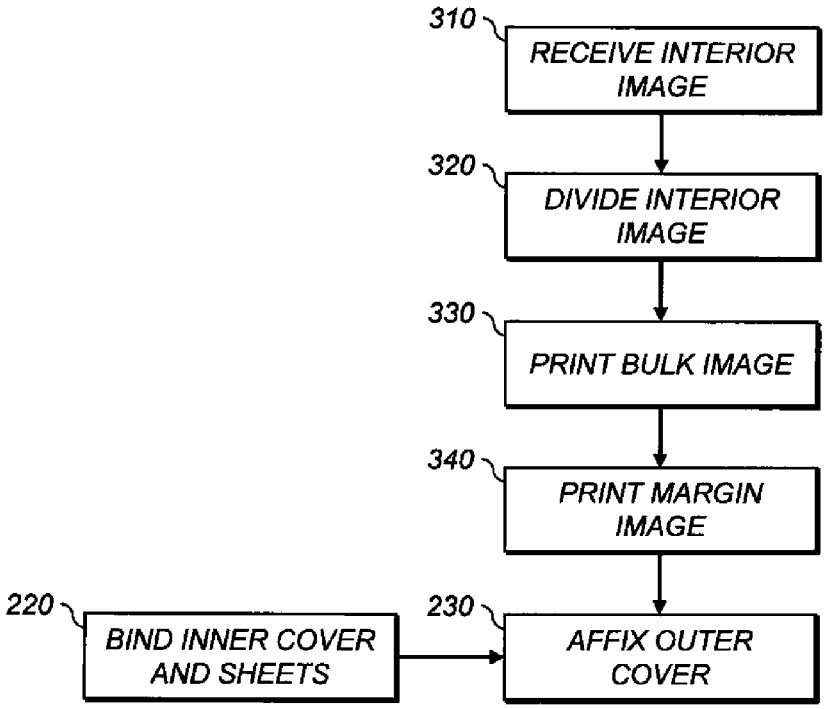
FIG. 3 is a partial flowchart showing additional ways of producing bound documents.

FIG. 3 is a partial flowchart showing additional ways of producing bound documents. Processing begins with step 310. Various steps from FIG. 2 are included as appropriate in these methods even though not expressly shown.

In step 310, image data for an interior image are received. Step 310 is followed by step 320.

In step 320, the image data for the interior image are divided into a margin image portion and a bulk image portion. The division can be along a straight line or a non-straight curve of a desired shape. Step 320 is followed by step 330.

In step 330, before binding step 220, the bulk image portion is printed on an interior side of the inner cover sheet. Step 330 is followed by step 340.

In step 340, before cover-affixing step 230, the margin image portion is printed on an interior side of the outer cover sheet. Step 340 is followed by step 230.

In step 220, the inner cover and sheets are bound as described above with reference to FIG. 2. Step 220 is followed by step 230.

In step 230, in addition to the description with respect to FIG. 2, discussed above, the inner and outer cover sheets are aligned so that the respective interior sides together form the interior image.

Figure 4:
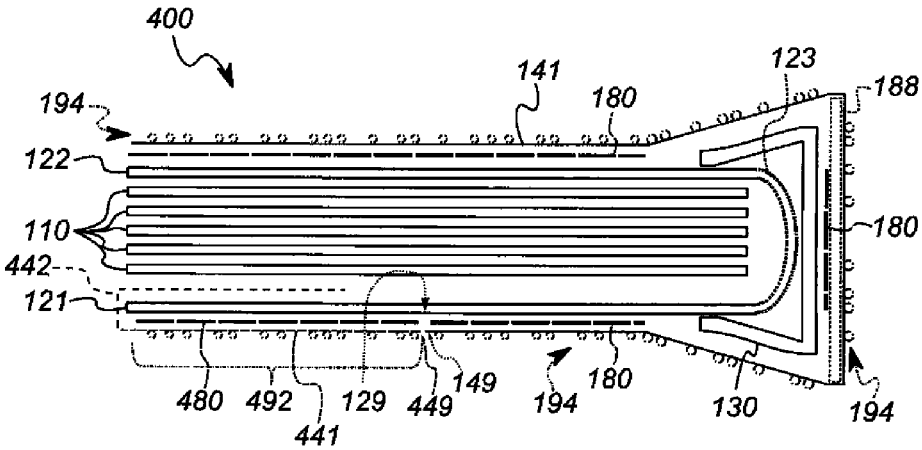
FIG. 4 is a cross-section of a bound document.

FIG. 4 is a cross-section of bound document 400 having a plurality of sheets 110. Cover image data are divided along a sheet-edge curve into first and second image portions, as discussed above. The first image portion, here image 492, is printed on supplemental cover sheet 441. The first image portion is printed borderlessly with respect to selected edge 449 (straight or not) of supplemental cover sheet 441.

Inner cover sheet 121, the plurality of sheets 110, and optionally second inner cover sheet 122 are bound so that alignment location 129 is defined on inner cover sheet 121 corresponding to the sheet-edge curve, as discussed above.

Second image portion 194 is printed on outer cover sheet 141. Second image portion 194 is printed borderlessly with respect to selected edge 149 of outer cover sheet 141.

Supplemental cover sheet 441 is affixed to inner cover sheet 121, e.g., using adhesive 480. Selected edge 449 of supplemental cover sheet 441 aligns with alignment location 129, within tolerances. Alignment location 129 and corresponding features can be selected based on the thickness of the final bound book and the length of outer cover sheet 141: the thicker the book, the closer alignment location 129 is to the spine of the book. Outer cover sheet 141 is also affixed to inner cover sheet 121 so that selected edge 149 aligns with alignment location 129, within tolerances. Any gap between supplemental cover sheet 441 and outer cover sheet 141 can be filled by toner, plastic, potting compound, or other techniques, or can be left unfilled.

Supplemental cover sheet 441 can wrap around the end of inner cover sheet 121, as shown by extension 442. Extension 442 can be adhered to inner cover sheet 121 by adhesive between the two (for clarity, not shown).

Carry-through 123, binder clip 130, adhesive 180, and spine shim 188 are as discussed above with respect to FIG. 1. The large gap visible between sheets 110 and inner cover sheet 121 is for clarity and is not limiting.

Figure 5:
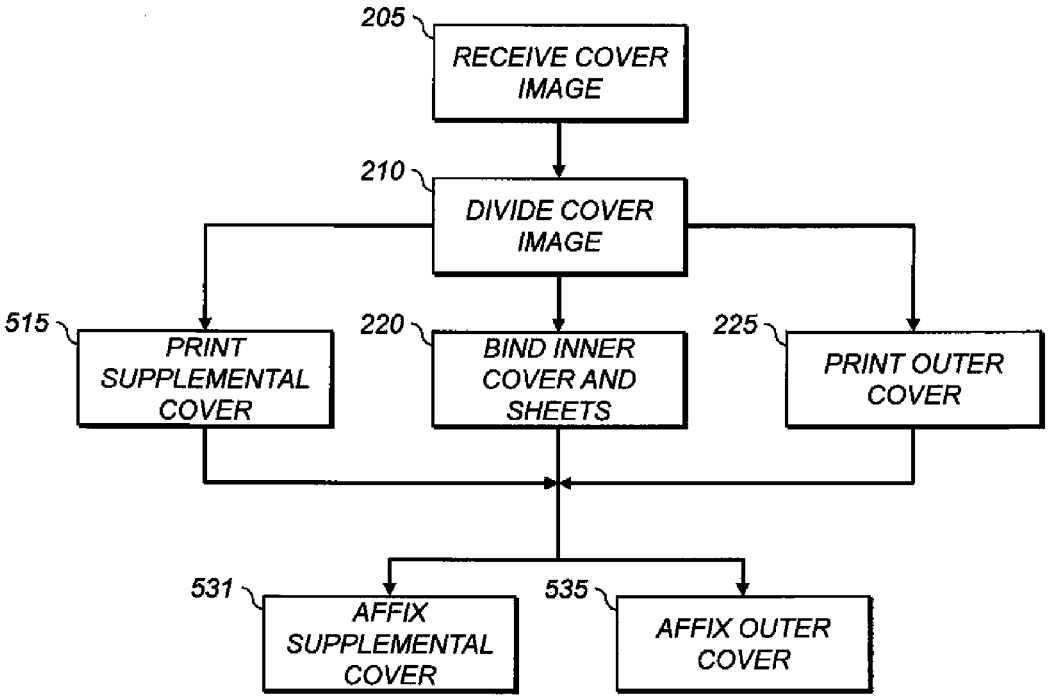
FIG. 5 is a flowchart showing ways of producing a bound document having a plurality of sheets.

FIG. 5 is a flowchart showing ways of producing a bound document having a plurality of sheets. Various steps described above with respect to FIG. 2 can also be used with these methods. Processing begins with step 205.

In step 205, image data for a cover image is received. Step 205 is followed by step 210.

In step 210, the image data for the cover image is divided along a sheet-edge curve into first and second image portions. The sheet-edge curve can be a straight line or another shape. Step 210 is followed by step 225, step 515, and step 220 in any order or simultaneously.

In step 220, the inner cover sheet and the plurality of sheets are bound together, as discussed above. An alignment location is defined on the inner cover sheet corresponding to the sheet-edge curve. Step 220 is followed by steps 531 and 535.

In step 515, which is a first printing step, the first image portion is printed on a supplemental cover sheet. The first image portion is printed borderlessly with respect to a selected edge (straight or not) of the supplemental cover sheet. Step 515 is followed by steps 531 and 535.

In step 225, which is a second printing step, the second image portion is printed on an outer cover sheet. Steps 515, 225 can be performed in either order. The second image portion is printed borderlessly with respect to a selected edge, not necessarily straight, of the outer cover sheet. Step 225 is followed by steps 531 and 535.

Steps 531 and 535 can be performed in any order or simultaneously. In step 531, which is a supplemental-cover-affixing step, after binding step 220, the supplemental cover sheet is affixed to the inner cover sheet so that the selected edge of the supplemental cover sheet aligns with the alignment location.

In step 535, which is a cover-affixing step, after binding step 220, the outer cover sheet is affixed to the inner cover sheet so that the selected edge of the outer cover sheet aligns with the alignment location to form the bound document. As a result of the alignment, the first and second image portions align to form the full image.

Referring back to FIG. 1, in various aspects, a pre-printed inner cover sheet 121 is used. Sheets 110 in the plurality of sheets have a length. Each sheet 110 is as long (measured left-to-right, as shown) as the length, within tolerances, e.g., ±1 mm. Bound document 100 includes outer cover sheet 141 having a length less than twice the length of the sheets in the plurality of sheets. As shown in FIG. 1, outer cover sheet 141 does not wrap all the way around sheets 110 and inner cover sheet 121. Outer cover sheet 141 has selected edge 149, and cover image 194 is printed on outer cover sheet 141.

Inner cover sheet 121 wraps around sheets 110 using carry-through 123, as discussed above. Inner cover sheet 121 therefore includes carry-through 123 and inner cover sheet 122. Inner cover sheet 121 has first side 131 and second side 132. First side 131 includes a first portion on which additional image 192 is printed, and a second portion (beginning at alignment location 129 and extending, with gaps, counter-clockwise around side 131) over which adhesive 180 is disposed. The first and second portions are separated by an alignment curve (not shown; corresponds to alignment location 129).

Binder clip 130 binds inner cover sheet 121 and the plurality of sheets 110 so that second side 132 of inner cover sheet 121 faces the plurality of sheets 110. Outer cover sheet 141 is affixed by adhesive 180 to side 131 of inner cover sheet 121 so that selected edge 149 aligns (within tolerances, as discussed herein) with the alignment curve (alignment location 129).

Image 192 on side 131 of inner cover sheet 121 can include text or image content. It can be printed simplex (only on side 131) or duplex (also on side 132). Image content described above with respect to step 215 (FIG. 2) can be printed on inner cover sheet 121.

Figure 6:
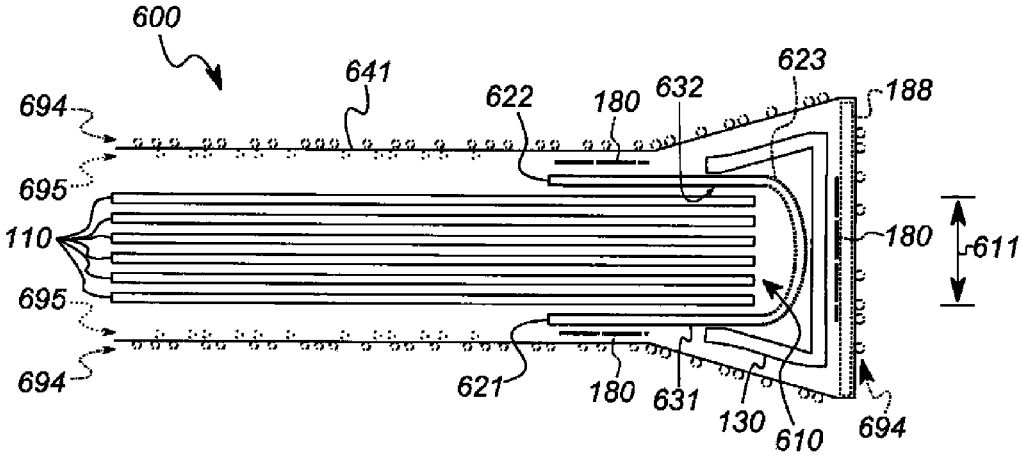
FIGS. 6-7 are cross-sections of bound documents.

FIG. 6 is a cross-section of a bound document. Document 600 includes a plurality of sheets 110, e.g., in a stack. Sheets 110 have a length, as discussed above with respect to FIG. 1. Inner cover sheet 621 and second inner cover sheet 622 are on opposite sides of sheets 110. Spine shim 188 is as shown in FIG. 1. Document 600 can be made as described above, omitting printing on the inner cover sheet (e.g., step 215 shown in FIG. 2).

Inner cover sheet 621, sheets 110, and optional second inner cover sheet 622 are bound together, as discussed above, e.g., using binder clip 130. Inner cover sheet 621 and second inner cover sheet 622 are shown as extending significantly less distance from the spine than outer cover sheet 641. However, any length inner cover sheet 621 or second inner cover sheet 622 can be used. Inner cover sheet has first side 631 and second side 632, and adhesive 180 is disposed over a portion of first side 631.

In various examples, inner cover sheet 621 includes carry-through 623 and second inner cover sheet 622. Inner cover sheet 621 has a length less than the length of sheets 110 in the plurality of sheets. In other examples, the plurality of sheets 110 forms a stack having thickness 611. Inner cover sheet 621 has a length equal to thickness 611 plus an adhesive allowance. The portion of inner cover sheet 621 over which adhesive 180 is disposed includes two spaced-apart areas on first side 631 that are not adjacent to spine edges 610 of sheets 110, which are the edges of sheets 110 closest to binder clip 130. In the example shown, two separate segments of adhesive 180 are disposed over side 631 away from carry-through 623 of inner cover sheet 621.

Outer cover sheet 641 is a cover for document 600. Outer cover sheet 641 has a length more than twice the length of the sheets in the plurality of sheets, so it can wrap around the sheets. Image data for a cover image is printed simplex on outer cover sheet 641 as image 694. Outer cover sheet 641 is affixed to inner cover sheet 621 or second inner cover sheet 622 using adhesive 180, e.g., pressure-sensitive adhesive strips with or without substrates. In various examples, interior image 695 is printed on the side of outer cover sheet 641 opposite image 694, i.e., outer cover sheet 641 is printed duplex.

Figure 7:
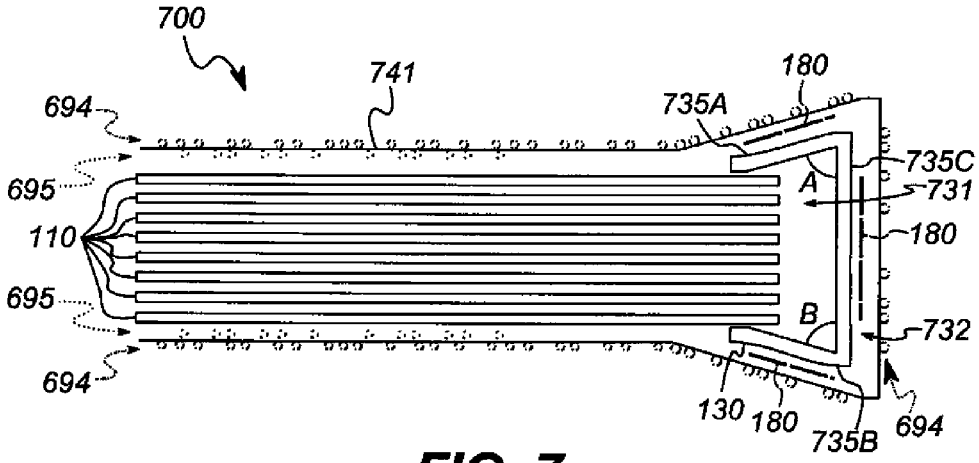

FIG. 7 is a cross-section of a bound document. Document 700 includes a plurality of sheets 110, e.g., in a stack. The sheets have a length, as discussed above. Document 700 can be made as described above, omitting the inner cover sheet (e.g., step 215 shown in FIG. 2) and modifying other steps accordingly (e.g., step 220).

Sheets 110 are bound together, as discussed above, e.g., using binder clip 130. Outer cover sheet 741 is a cover for document 700. Image data for a cover image is printed simplex on outer cover sheet 741 as image 694. Outer cover sheet 741 is affixed to binder clip 130 using adhesive 180, e.g., pressure-sensitive adhesive strips with or without substrates. Binder clip 130 has a squared-off shape (not necessarily exactly 90° angles) to provide both a square spine and the binding force to secure sheets 110 together. A spine shim can also be used, e.g., as shown in FIG. 6. In various examples, interior image 695 is printed on outer cover sheet 741, as discussed above.

In various aspects, outer cover sheet 741 has a length more than twice the length of sheets 110. Binder clip 130 has interior 731 and exterior 732. The plurality of sheets 110 are bound together in interior 731. Binder clip 130 has adhesive 180 disposed over exterior 732. Outer cover sheet 741 is affixed by adhesive 180 to binder clip 130.

In various aspects, binder clip 130 includes center panel 735C and side panels 735A, 735B. The respective angles A, B between center panel 735C and side panels 735A, 735B are less than 90°. Adhesive 180 is disposed over exterior 732 of center panel 735C and of each side panel 735A, 735B.

The invention is inclusive of combinations of the aspects described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred aspects thereof, but it will be understood that variations, combinations, and modifications can be effected by a person of ordinary skill in the art within the spirit and scope of the invention.

PARTS LIST

100 document
110 sheet

121 inner cover sheet
122 second inner cover sheet
123 carry-through
129 alignment location
130 binder clip
131, 132 side
141 outer cover sheet
149 edge
180 adhesive
188 spine shim
192, 194 image
205 receive cover image step
210 divide cover image step
215 print inner cover step
220 bind inner cover and sheets step
222 clip bind step
224 affix spine shim step
225 print outer cover step
227 print second inner cover step
230 affix outer cover step
232 apply pressure step
310 receive interior image step
320 divide interior image step
330 print bulk image step
340 print margin image step
400 document
441 supplemental cover sheet
442 extension
449 edge

PARTS LIST

Continued

480 adhesive
492 image
515 print supplemental cover step
531 affix supplemental cover step
535 affix outer cover step
600 document
610 spine edge of sheet
611 thickness
621, 622 inner cover sheet
623 carry-through
631, 632 side
641 outer cover sheet
694 image
695 image
700 document
731 interior
732 exterior
735A, 735B side panel
735C center panel
741 outer cover sheet
A, B angle

The invention claimed is:

1. A method of producing a bound document having a plurality of sheets, the method comprising:

receiving image data for a cover image;

dividing the image data along a sheet-edge curve into first and second image portions;

a first printing step of printing the first image portion on an inner cover sheet so that an alignment location is defined on the inner cover sheet corresponding to the sheet-edge curve;

binding the inner cover sheet and the plurality of sheets;

a second printing step of printing the second image portion on an outer cover sheet, wherein the second image portion is printed borderlessly with respect to a selected edge of the outer cover sheet; and a cover-affixing step of, after the binding step, affixing the outer cover sheet to the inner cover sheet so that the selected edge aligns with the alignment location to form the bound document.

2. The method according to claim 1, wherein the binding step includes inserting the inner cover sheet and the plurality of sheets into a binder clip.

3. The method according to claim 2, wherein the binder clip includes a center panel and two side panels, the respective angle between the center panel and each side panel being less than 90°.

4. The method according to claim 1, wherein the binding step includes binding the inner cover sheet near a spine edge thereof, the inner cover sheet includes pressure-sensitive adhesive (PSA) arranged closer to the spine edge than the alignment location, and the cover-affixing step includes applying pressure to adhere the outer cover sheet to the inner cover sheet using the PSA.

5. The method according to claim 1, wherein the outer cover sheet is larger than the inner cover sheet.

6. The method according to claim 1, wherein the sheet-edge curve, the alignment location, and the selected edge are straight.

7. The method according to claim 1, further including:

receiving image data for an interior image;

dividing the image data for the interior image into a margin image portion and a bulk image portion;

before the binding step, printing the bulk image portion on an interior side of the inner cover sheet;

before the cover-affixing step, printing the margin image portion on an interior side of the outer cover sheet;

wherein the cover-affixing step includes aligning the inner and outer cover sheets so that the respective interior sides together form the interior image.

8. The method according to claim 1, wherein the dividing step further includes dividing the image data along a second sheet-edge curve to form a third image portion;

further including a third printing step of printing the third image portion on a second inner cover sheet so that a second alignment location is defined on the second inner cover sheet corresponding to the second sheet-edge curve; and wherein the binding step further includes binding the second inner cover sheet opposite the plurality of sheets from the inner cover sheet;

the second printing step includes printing the second image portion borderlessly with respect to a second selected edge of the outer cover sheet; and the cover-affixing step further includes affixing the outer cover sheet to the second inner cover sheet so that the second selected edge aligns with the second alignment location.

9. The method according to claim 1, wherein the first and the second printing steps include printing the first and the second image portions, respectively, using a single printing device.

10. The method according to claim 1, wherein the first and the second printing steps include printing the first and the second image portions, respectively, on respective sheets of a single type of media.

11. The method according to claim 1, wherein the binding step includes wrapping the inner cover sheet around the plurality of sheets to define first-side and second-side inner cover portions of the inner cover sheet on opposite sides of the plurality of sheets, and the cover-affixing step includes affixing the outer cover sheet to the first-side inner cover portion so that the selected edge aligns with the alignment location, and affixing the outer cover sheet to the second-side inner cover portion.

12. The method according to claim 1, wherein:

the binding step further includes binding a second inner cover sheet opposite the plurality of sheets from the inner cover sheet, and the cover-affixing step further includes affixing the outer cover sheet to the second inner cover sheet.

13. The method according to claim 1, wherein the binding step includes clamping the inner cover sheet and the plurality of sheets together using a binder clip.

14. The method according to claim 13, further including affixing a spine shim to the binder clip before the cover-affixing step.

15. The method according to claim 1, wherein the dividing-image-data step includes reducing a spatial resolution of the image data in a selected blur region including the sheet-edge curve.

16. A method of producing a bound document having a plurality of sheets, the method comprising:

receiving image data for a cover image;

dividing the image data along a sheet-edge curve into first and second image portions;

a first printing step of printing the first image portion on a supplemental cover sheet, wherein the first image portion is printed borderlessly with respect to a selected edge of the supplemental cover sheet;

binding an inner cover sheet and the plurality of sheets so that an alignment location is defined on the inner cover sheet corresponding to the sheet-edge curve;

a second printing step of printing the second image portion on an outer cover sheet, wherein the second image portion is printed borderlessly with respect to a selected edge of the outer cover sheet;

a supplemental-cover-affixing step of, after the binding step, affixing the supplemental cover sheet to the inner cover sheet so that the selected edge of the supplemental cover sheet aligns with the alignment location; and a cover-affixing step of, after the binding step, affixing the outer cover sheet to the inner cover sheet so that the selected edge aligns with the alignment location to form the bound document.

* * * * *